United States Patent [19]

Hurh

[11] Patent Number: 4,998,656

[45] Date of Patent: Mar. 12, 1991

[54] ROLL-RESTRAINING DISPENSING CARTON

[75] Inventor: Patrick G. Hurh, Geneva, Ill.

[73] Assignee: DowBrands Inc., Indianapolis, Ind.

[21] Appl. No.: 394,681

[22] Filed: Aug. 16, 1989

[51] Int. Cl.[5] ..... B26F 3/02; B65D 85/672

[52] U.S. Cl. ..... 225/47; 255/50

[58] Field of Search ..... 225/25, 46, 47, 48, 225/50, 90

[56] References Cited

U.S. PATENT DOCUMENTS

| | | | |
|---|---|---|---|
| 2,330,117 | 9/1943 | Feinberg | 225/47 |
| 2,472,521 | 6/1949 | Danenbauer | 225/47 |
| 2,743,009 | 4/1956 | Williamson et al. | 225/47 |
| 2,803,339 | 8/1957 | Kuchenbecker | 225/47 |
| 3,144,970 | 8/1964 | Beschmann | 225/48 |
| 3,477,624 | 11/1969 | Branyon et al. | 225/47 |
| 3,517,870 | 6/1970 | Voytko | 225/34 |
| 3,698,548 | 10/1972 | Stenzel et al. | 206/53 |
| 4,238,065 | 12/1980 | Ragsdale | 225/47 |

*Primary Examiner*—Hien H. Phan

*Attorney, Agent, or Firm*—J. Robert Dean, Jr.

[57] ABSTRACT

Disclosed is a dispensing container for material in roll form having receptacle-like collars which prevent inadvertent removal or "pop-out" of the roll when sheet-like material is drawn from the roll. The collars are inwardly inclined and situated in the ends of the dispensing container.

11 Claims, 4 Drawing Sheets

ROLL-RESTRAINING DISPENSING CARTON

BACKGROUND

This invention relates to an improved dispensing container for thin, flexible, sheet-like materials in roll form, particularly polymeric films, waxed paper, and like wrapping material for household and industrial use. The dispensing container is a derivative of a long, rectangular "trunk-lid" style carton, wherein the improvement comprises means to prevent the inadvertent removal or "pop-out" of the contained roll from the container when sheet-like material is pulled from the roll.

The problem with inadvertent removal or pop-out of the roll arises from normal and intended use of the container, which is to provide a holder for the roll and facilitate the removal of the sheet-like material in segments of varied lengths. When the force necessary to rotate and unravel the roll, or technically, to separate a layer of sheet-like material from the successive underlying layer of same material exceeds the total resistance against removing the roll from the container, the roll will pop out of the container in a direction normal to the force applied. The resistance against the removal of the roll from the container is a function of the angle of pull, friction between the outer surfaces of the sheet-like material on the rotating roll and inner container surfaces contacting thereto, and container structural panels that partially or totally restrain non-rotational movement of the roll.

The problem of roll pop-out is especially acute with high "cling" polymeric films such as those made wholly or partly of polyvinylidene chloride, polyethylene, and their derivatives. The term "cling" refers to the intrinsic or extrinsically introduced property of a film to stick to itself or various host surfaces.

Attempts in the prior art to rectify the problem of roll pop-out in containers which dispense sheet-like materials have consisted primarily of inserting or fabricating single or multi-wall collars or receptacles for the roll ends with full circle, 360° holes or cavities therein positioned adjacent to the side panels. The holes have a diameter slightly larger than that of roll ends to be inserted in order to allow rotation of the roll.

Prior art containers have fabricated the desirable receptacles for the rolls of sheet-like material by utilizing complicated multifolded side panels such as seen in U.S. Pat. Nos. 3,477,624, 3,698,548, 2,330,117, 3,114,970, 3,144,970, and 4,238,065. Accordingly, there exists a need for a dispensing container for rolls of sheet-like material that provides receptacles which prevent roll pop-out yet are relatively easily fabricable and uncomplicated in structure. Simplification in structure may result in enhanced ease of manufacture.

SUMMARY OF THE INVENTION

The invention described herein discloses a dispensing container having means to restrain and prevent a roll of sheet-like material from being inadvertently pulled from the container when sheet-like material is drawn therefrom.

The restraining means comprises retention members having the form of receptacle-like collars positioned in each of the ends of the container and attached to the back panel. The retention members are attached to the back panel, and extend inclined at an acute angle into the interior of the container and abut the front corners thereof. The collars are retentionally coextensive with and adapted to receiving end portions of a core of the roll.

BRIEF DESCRIPTION OF THE DRAWINGS

The novel features of the present invention and the context within which they are set will be better understood upon reviewing the following specification together with the several drawings in which the same reference numbers are employed for the same parts in the various views and wherein.

DETAILED DESCRIPTION

Figures 1, 2:
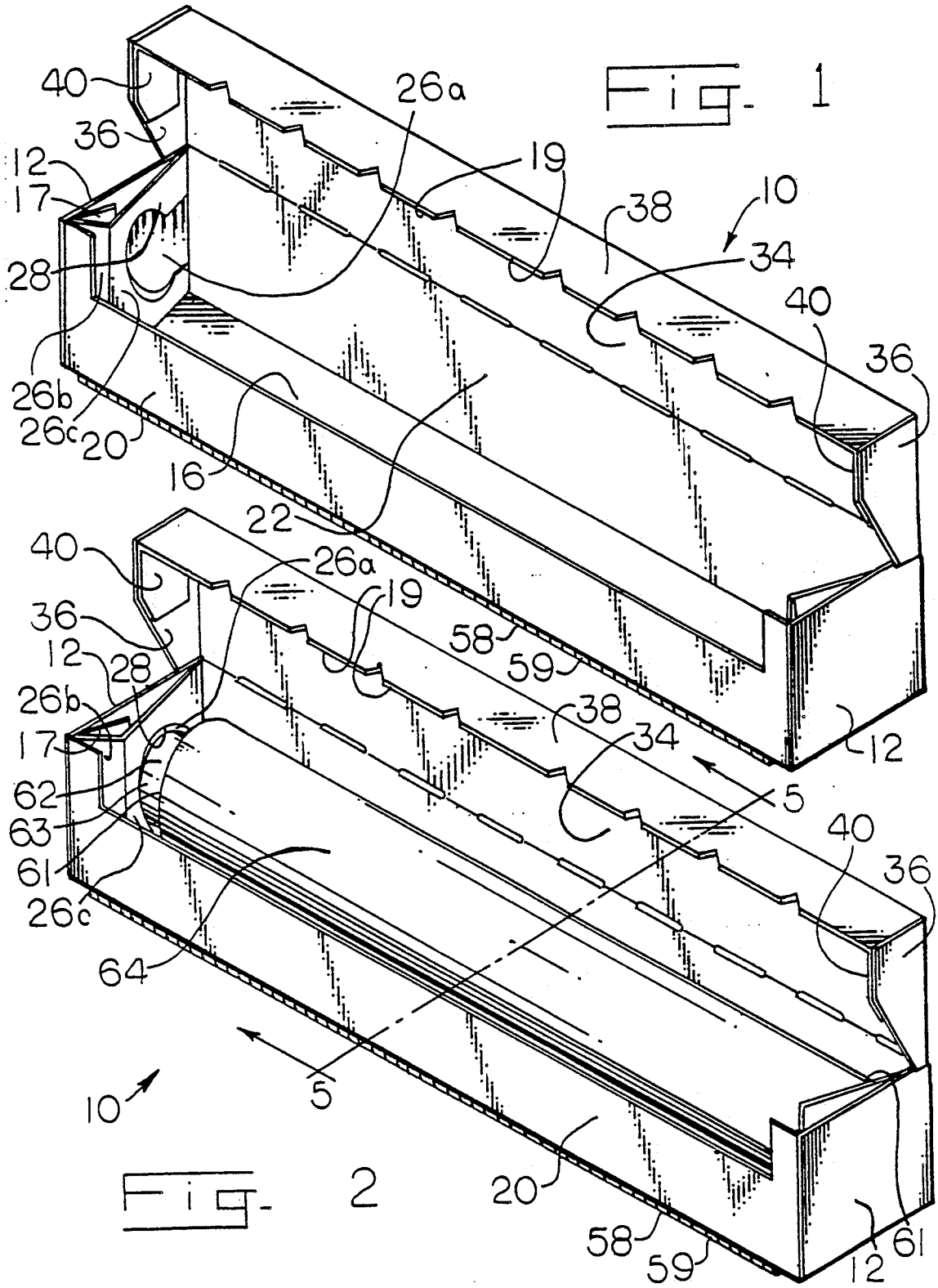
FIG. 1 is a front isometric view of a trunklid style dispensing container made in accordance with the present invention in open configuration without a roll or core therein.
FIG. 2 is a front isometric view of the dispensing container of FIG. 1 with a roll of sheet-like material situated therein.

Referring now to FIG. 1, a dispensing container constructed in accordance with this invention for film, paper, foil, or other sheet-like materials supplied in roll form is generally designated by reference numeral 10. Container 10 is disclosed for purposes of description, and is not to be construed as limiting.

Container 10 forms a generally hollow, rectangular box, and is primarily composed of a plurality of panels foldably connected. All folding lines connecting structural elements or parts of container 10 are generally designated by reference number 18, regardless of location. Location of folding lines 18, are defined by the elements or parts they connect.

The rectangular portion of container 10 comprises a bottom panel 16, a back panel 22, a front panel 20, a top panel 34, and a front flange 38. Front panel 20, is connected to bottom panel 16 along a folding line 18, bottom panel 16 is connected to back panel 22 along a folding line 18, back panel 22 is connected to top panel 34 along a folding line 18, and top panel 34 is connected to front flange 38 along a folding line 18.

Front panel 20 may vertically extend from the lowest portion to the uppermost portion of the front portion of dispensing container 10. Preferably, however, front panel 20 vertically extends from the lowest portion to a height of between one-third and two-thirds of the front portion. For purposes of defining the height of front panel 20, front portion of container 10 includes front panel 20, front flange 38, and any space or aperture therebetween.

FIG. 2 illustrates container 10 with a roll 64 therein. Preferably, roll 64 comprises a core 62, a long, usually cylindrical piece of cardboard, paperboard, or other rigid material, and sheet-like material 60, which is circumferentially and concentrically wrapped on core 62.

The dimension between the side or transverse edges 61 of sheet-like material 60 is preferably less than the length of core 62 upon and around which it is situated to the extent necessary to prevent material 60 from becoming entangled in the retention members 26 when material 60 is drawn from container 10. Transverse edges 61 of material 60 are the edges defining the non-machine or transverse dimension of material 60. End portions 63 of core 62 are defined by the portions of core 62 extending beyond transverse edges 61 of material 60, which is situated on core 62. The width of the collars formed by retention members 26 along the length of core 62 determines the minimum difference in transverse dimension or width of material 60 and the length of core 62. End portions 63 of core 62 are embraced within the receptacle-like collars of retention members 26 when material 60 is drawn from dispenser 10.

The trunk lid comprises the combination of a top panel 34, a front flange 38, first and second side flanges 36, and top construction flaps 40. Side flanges 36 are connected to the end portions of top panel 34 along folding lines 18. Front flange 38 is connected to top panel 34 along a folding line 18. Side flanges 36 and front flange 38 are generally perpendicular to top panel 34 and to each other and secured therewith by top construction flaps 40. Top construction flaps 40, which are connected to front flange 38 by folding lines 18, are adhered to the undersurfaces of side flanges 36 by glue means. The trunk lid is connected to back panel 22 along a folding line 18 at the juncture of top panel 34 and back panel 22. Folding line 18 at the juncture this preferably grooved or perforated to enhance flexibility.

A cutter bar 58, a metal, plastic, or cardboard strip or bar having a straight, serrated, or grooved edge 59 is preferably mounted flush to the outer surface of bottom panel 16 and positioned so that edge 59 is exposed at the front panel-bottom panel interface. Preferably, edge 59 is grooved. Cutter bar 58 generally extends from one end of the dispensing container 10 to the other. Sheet-like material 60 may be drawn across edge 59 and severed along a generally straight line in a line pattern similar to that of the edge. When tab flange 37 is detached from the package 70, edge 59 is exposed.

Figure 7:
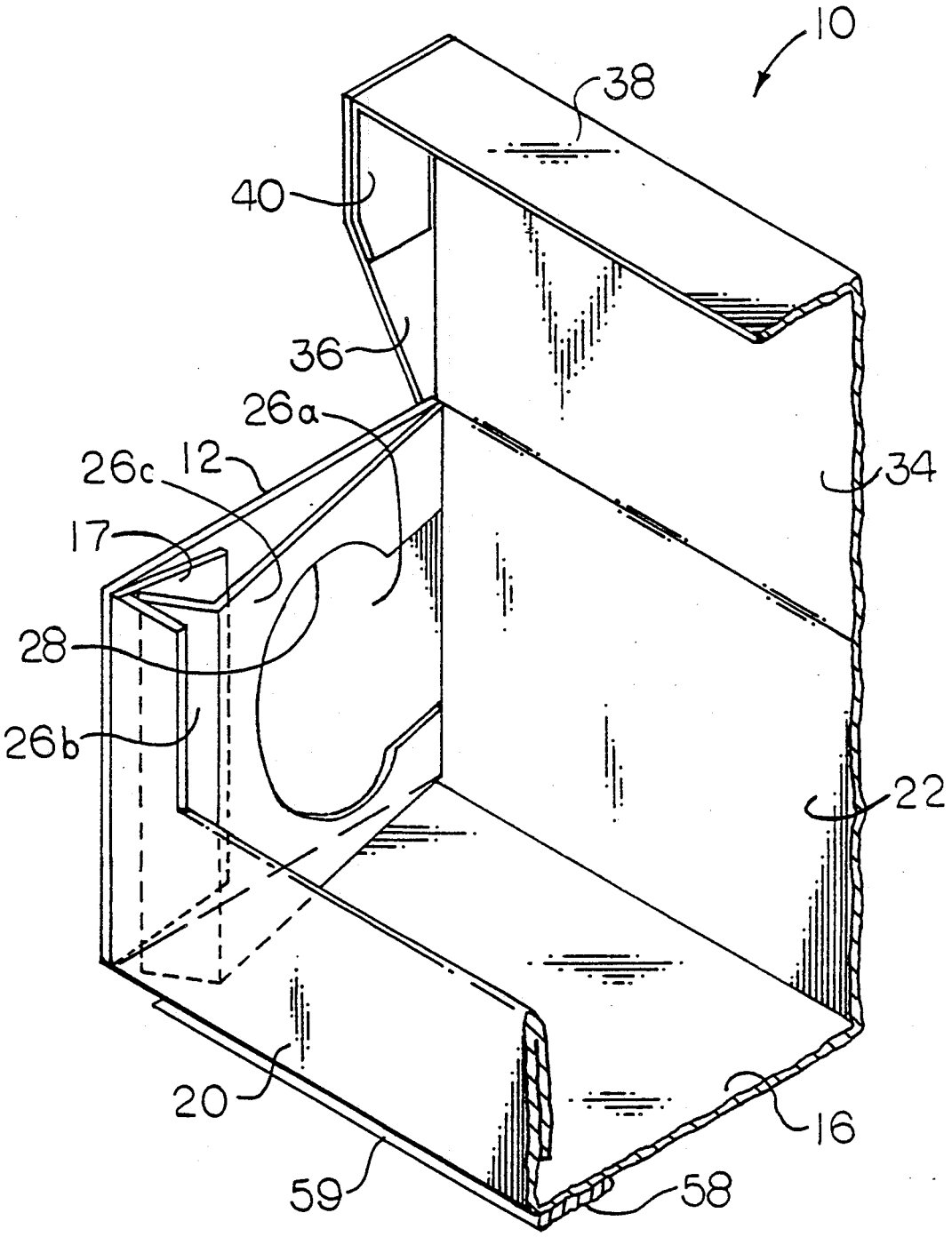
FIG. 7 is a fragmentary, front isometric view of the dispensing container of FIG. 1.

Restraining means for preventing inadvertent removal or pop-out of roll 64 from the container 10 when sheet-like material 60 is drawn therefrom comprise retention members 26. Container 10 has first and second retention members 26 defining receptacle-like collars 28. Collars 28 are retentionally coextensive with and adapted to receive the end portions of core 62 of roll 64. "Retentionally coextensive" means that collars 28 are of a shape and size to allow the end portions of core 62 to be embraced and to rotate therewithin when sheet-like material 60 is being drawn from roll 64. The fit of the end portions of core 62 may be either relatively tight or loose so long as roll 64 is retained in container 10 when material 60 is withdrawn. The preferred shape of both collars 28 and the end portions of core 62 is circular though collars 28 may be semicircular toward the front of retentions member 26 and oblong or of a tapered configuration toward the rear of same. Retention members 26 are illustrated in FIGS. 1, 2, and 7 by their constituent structural parts enumerated immediately below.

Retention members 26 comprise flaps 26*a*, struts 26*b*, and receptacle sides 26*c*. Struts 26*b* are connected to receptacles sides 26*c* along folding lines 18. Receptacle sides 26*c* and flaps 26*a* are connected to end panel 22 along folding lines 18. Flaps 26*a* are parallel and adjacent to side panels 12, and adhered thereto to provide support and rigidity for members 26. Receptacle sides 26*c* incline inward at an acute angle with respect to side panels 12 and flaps 26*a*. Struts 26*b* are positioned outward at generally right angles with respect to receptacle sides 26*c* and connected thereto. The front portions of struts 26*b* generally abut the front corners of container 10, and may be but preferably are not fastened thereto to eliminate a glueing process step. Receptacle sides 26*c* preferably extend all the way back to the rear corners of container 10 to enhance retention of roll 64 in container 10. Receptacle sides 26*c* further preferably connect to back panel 22.

The inclined configuration of retention members 26 offers a substantial advantage over the container structures found in the prior art that function to retain a dispensing roll. The prior art structures previously enumerated utilize relatively complicated multifold structures to obtain a receptacle-like collar for a core of a roll. The present structure offers a functionally equivalent receptacle-like collar in a retention member having only one fold.

It will be obvious to the skilled practitioner that retention members 26 may be secured in dispensing container 10 by any suitable fastening means, including conventional adhering or glue means, folding lines, mechanical fasteners or any combination of the preceding thereof. It will likewise be obvious from viewing the embodiments of this invention that a roll restraining means possessing the structural features of the present invention may be formed by other means than those of the disclosed embodiments. Retention members 26 may be formed in conjunction with the remainder of container 10 or situated in container 10 after the remainder of container 10 is formed. Retention members 26 may be formed of the same or different material of construction as the remainder of container 10.

Figure 5:
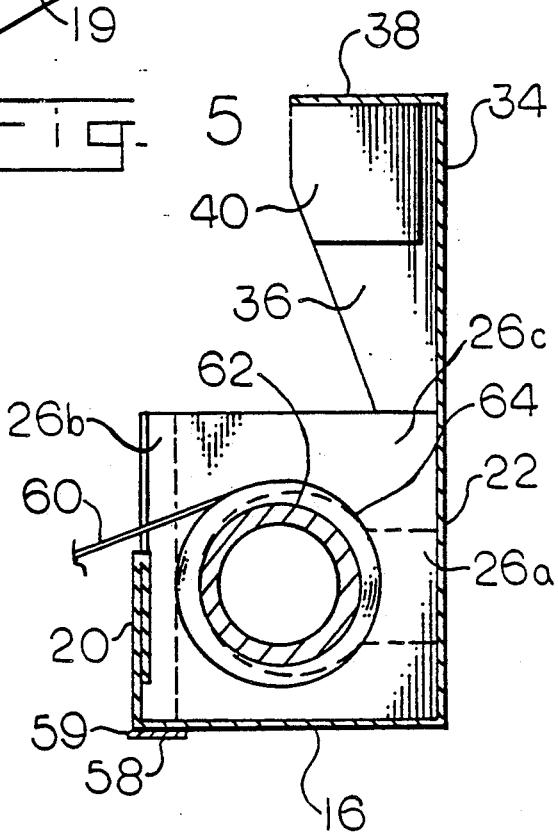
FIG. 5 is a cross-sectional side view of the dispensing container of FIG. 2 taken along line 5—5 thereof, the core of the roll being engaged in collars of the retention members while sheet-like material is drawn from the roll.

FIG. 5 shows dispensing container 10 in open configuration with a roll 64 therein from which sheetlike material 60 is being drawn off core 62. Core 62 rotates in collars 28 while material 60 is dispensed. Roll 64 is not allowed to pop out since collars 28 of retention members 26 laterally or horizontally dissipate the vertical component of the force of pull of material 60 acting to cause inadvertent removal or pop-out of roll 64.

Figure 6:
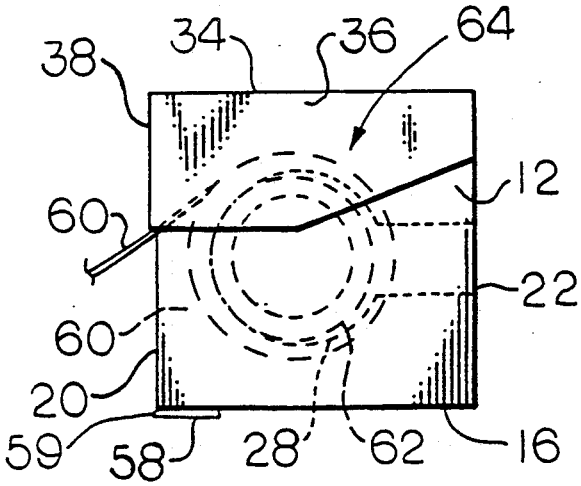
FIG. 6 is an end view of the dispensing container of FIG. 1 while the core of the roll is shown partially in dotted lines engaged in the collars of the retention members while sheet-like material is drawn from the roll.

FIG. 6 shows the position in cutaway of roll 64 in container 10 in closed configuration when core 62 is engaged in collars 28 provided by retention members 26. Sheet-like material 60 is being drawn through a slot-like aperture 31 between front flange 38 and front panel 20.

Figure 3:
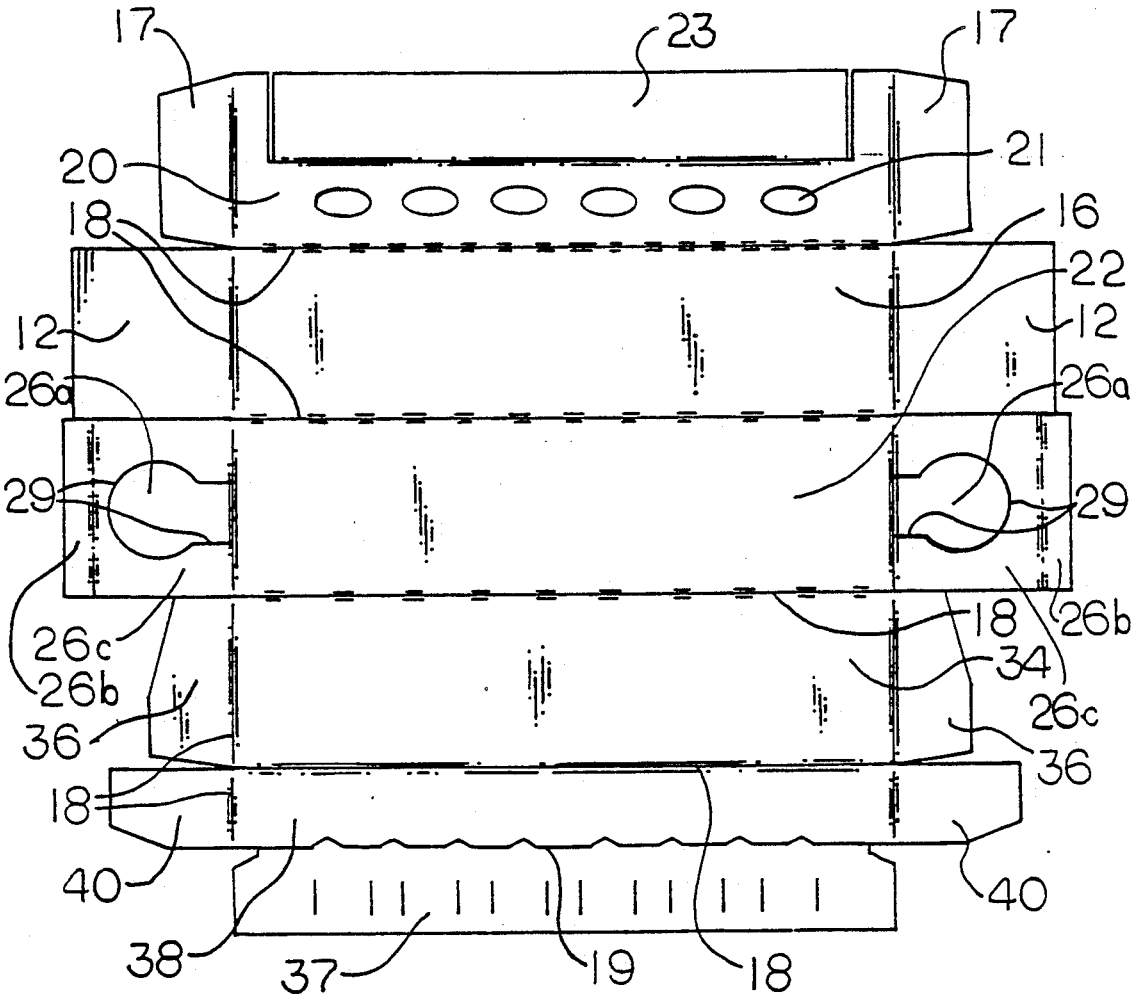
FIG. 3 is a planar view of a blank as cut, scored and perforated, and from which the container of FIG. 1 is formed.
Figure 4:
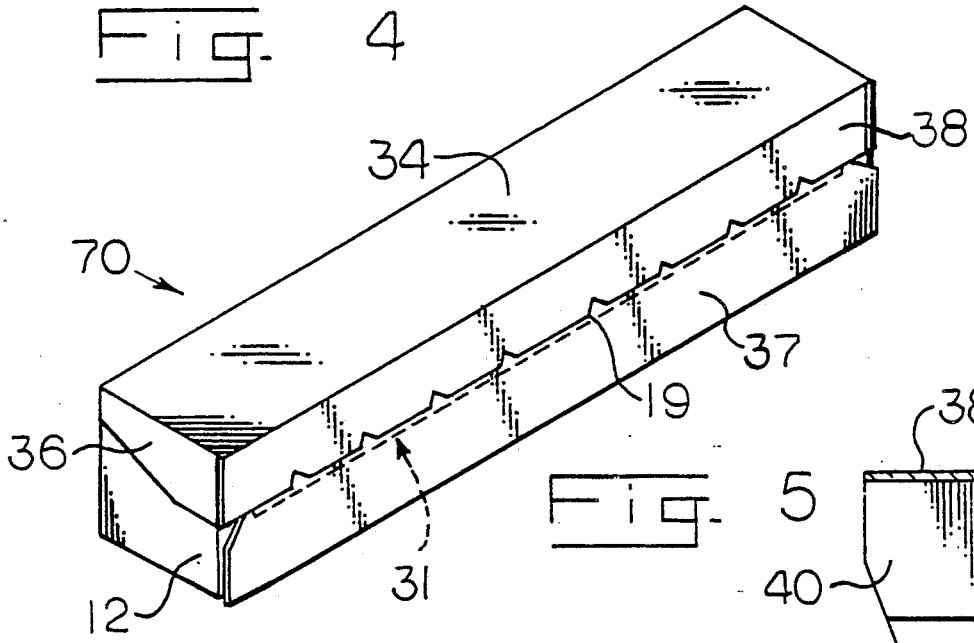
FIG. 4 is a front isometric view of the dispensing container and roll of sheet-like material of FIG. 2 in a closed, sealed configuration.

FIG. 4 illustrates a package 70, which comprises dispensing container 10 in closed, sealed condition with retention members 26 and roll 64, all of FIG. 2, therein. Package 70 is sealed by a tab flange 37, which is attached to front flange 38 along a grooved line 19, and is in contiguous overlap with front panel 20. Front panel 20 has a plurality of oval-shaped impressions 21, shown in FIG. 3, traversing its length upon which conventional glue means are situated to secure the contiguous overlap of tab flange 37.

Referring to package 70, tab flange 37 extends in length down the lower positioned frontal surface of package 70 sufficient to cover the exposed edge of cutter bar 58. Cutter bar 58 is illustrated in FIGS. 1, 2, 5, 6, and 7. Tab flange 37 is detachable from package 70 along grooved line 19, and is intended to be detached upon commencement of use of package 70 as dispensing container 10. Further, slot-like aperture 31 between front panel 20 and front flange 38 seen in FIG. 6 is exposed upon detaching tab flange 37 from front flange 38 and front panel 20.

FIG. 2 shows the position of roll 64 in container 10 at rest when sheet-like material 60 is not being withdrawn. Roll 64 lays between and adjacent retention member 26 and back panel 22, but is not engaged in the receptacles formed by retention members 26.

FIG. 3 shows a container blank 80. Blank 80 forms container 10 when formed or assembled.

Container blank 80 comprises a bottom panel 16, top panel 34, front flange 38, back panel 22, front panel 20, side panels 12, side flanges 36, top construction flaps 40, back construction flaps 11, front construction flaps 26, tab flange 37, overlap member 23, retention members 26 connected along folding lines 18.

Retention members 26 of container blank 80 have means forming receptacle-like collars for retention of end portions of core 62 upon assembly of dispensing container 10 from blank 80. The features, structure, and characteristics of retention members 26 of blank 80 formed upon assembly of blank 80 into dispensing container 10 are equivalent to those of retention members 26 of container 10 previously described herein.

Retention members 26 are attached to the end portions of container blank 80. Container blank 80 of FIG. 3 shows attachment of retention members 26 to the end portions of back panel 22 along folding lines 18.

Retention member 26 of blank 80 is preferably formed from a unitary piece in conjunction with the remainder of the container. Flaps **26*a* and receptacle sides 26*c* are adjacent as seen flat in blank 80, and their boundaries defined by a line of severance 29 therebetween in the construction material composing member 26. Line of severance 29 preferably takes a rounded, generally circular configuration in about the middle of members 26 and extends straight back to the folding lines 18 connecting members 26 and back panel 34 as seen in FIG. 3. Alternately, the line of severance could take a generally semicircular configuration toward the front of member 26, and extend substantially straight back from the highest and lowest points of the semicircle to the folding lines 18 connecting members 26 and back panel 34. Struts 26*b* are connected to the remainder of member 26 along folding lines 18**.

An overlap member 23, which is foldably connected to front panel 20 along a folding line 18, is folded back and adhered to the inner surface of front panel 20 by glue means to provide a low-friction leading surface along the top of front panel 20.

The various embodiments of container blank 80 can vary in shape or location of attachment of certain container structure features such as back construction flaps 11, side flanges 36, and top construction flaps 40 and still be within the scope of the present invention.

While the preferred embodiments of the invention have been shown with regard to specific details in container designs, it will be appreciated that depending upon the container design and the manufacturers desires, the invention may be modified by various changes while still being fairly within the scope of the general teachings and principles hereof.

What is claimed is:

1. A dispensing container for flexible sheet-like materials supplied in roll form, the dispensing container comprising a generally rectangular box, wherein the box has connected by folding lines a back panel, a front panel, first and second side panels, a bottom panel, and a roll restraining means for preventing inadvertent removal of a roll from the dispensing container when sheet-like material is to be drawn therefrom, the box defining front and rear corners, the roll restraining means comprising a retention member adjacent each side panel, the retention members defining collars for a roll having a core, the core having end portions, the collars being retentionally coextensive with and adapted to receive the end portions of the core, the retention members comprising struts and receptacle sides, the receptacle sides being inwardly inclined at an acute angle with respect to the side panels and extending to the rear corners, the struts being positioned outward at generally right angles with respect to the receptacle sides and connecting thereto, the struts having front portions, the front portions of the struts being in general abutment with the front corners.

2. The dispensing container as recited in claim 1, wherein the receptacle sides are connected to the back panel.

3. The dispensing container as recited in claim 1, wherein the retention members are foldably attached to the remainder of the dispensing container and are composed of the same material of construction as the remainder of the dispensing container.

4. The dispensing container according to claim 3, wherein the retention members are composed of cardboard.

5. The dispensing container according to claim 3, wherein the retention members are composed of paperboard.

6. The dispensing container as recited in claim 1, wherein the dispensing container further comprises first and second side flanges, a tab flange, a cutter bar having a cutting edge, and a front flange, wherein the bottom panel is foldably attached to the front panel and the back panel, the front flange being foldably attached to the top panel, the first and second side flanges being connected to the front flange, the first and second side flanges being foldably attached to the top panel, the top panel being foldably attached to the back panel, the cutter bar being mounted flush to the outer surface of the bottom panel such that the edge of the cutter bar is exposed at the front panel-bottom panel interface, the tab flange being detachable and connected to the front flange along a scored or grooved line, the inner surface of the tab flange being in contiguous overlapping contact with the outer surface of the front panel, such contact being secured therewith by adhering means situated on the outer surface of the front panel, and a slot-like aperture between the front panel and the front flange for withdrawing sheet-like material therethrough, the slot-like aperture being exposed when the tab flange is detached from the front flange and the front panel.

7. The dispensing container according to claim 6, wherein the adhering means comprises a plurality of oval-shaped impressions upon which glue means are situated.

8. The dispensing container as recited in claim 1, wherein a front portion of the container comprises the front panel, a front flange, and an aperture therebetween, the front panel extending from one-third to two-thirds the height of the front portion of the container.

9. The blank of claim 8 wherein the retention member is formed from a unitary piece, the flap and the receptacle being connected to the back panel, the flap and the receptacle having a line of severance therebetween.

10. A package, the package comprising the dispensing container of claim 1 and a roll of flexible sheet-like material therein.

11. A blank of a dispensing container for a roll of flexible sheet-like material, comprising an interconnected bottom panel, top panel, a front flange, a back panel, a front panel, first and second side panels, and first and second retention members, the retention members being attached to the back panel, the retention members having means forming collars retentionally coextensive with and adapted to receiving end portions of a core of the roll upon assembly of the dispensing container from the blank, the retention members comprising flaps, struts, and receptacle sides, the flaps being parallel and adjacent to the side panels, the receptacle sides being inwardly inclined at an acute angle with respect to the flaps and connected to the back panel, the struts being positioned outward at generally right angles with respect to the receptacle sides and connected thereto, the front panel, the side panels, and the bottom panel forming front corners, the struts having front portions, the front portions of the struts being in abutment with the front corners.

* * * * *